United States Patent [19]

Dolsky

[11] Patent Number: 4,523,588

[45] Date of Patent: Jun. 18, 1985

[54] PROTECTIVE PILLOW ASSEMBLY

[75] Inventor: Thomas P. Dolsky, Topeka, Kans.

[73] Assignee: Life Products, Inc., Topeka, Kans.

[21] Appl. No.: 372,124

[22] Filed: Apr. 27, 1982

[51] Int. Cl.[3] ..... A62B 7/00

[52] U.S. Cl. ..... 128/201.25; 128/202.18; 128/205.29

[58] Field of Search ..... 128/202.18, 202.19, 128/206.12, 206.17, 201.25, 201.29, 205.28, 201.23; 2/7, 8, 9, 205, 206; 604/362

[56] References Cited

U.S. PATENT DOCUMENTS

| | | | |
|---|---|---|---|
| 1,348,094 | 7/1920 | Del Re | 128/201.25 |
| 3,521,629 | 7/1970 | Reynolds | 128/201.23 |
| 3,562,813 | 2/1971 | Griger | 128/201.23 |
| 3,566,871 | 3/1971 | Richter et al. | 604/362 |
| 4,032,991 | 7/1977 | Van de Weghe | 128/201.25 |
| 4,231,118 | 11/1980 | Nakagawa | 2/205 |
| 4,411,023 | 10/1983 | Pinson | 2/7 |

*Primary Examiner*—Henry J. Recla
*Assistant Examiner*—Karin M. Reichle
*Attorney, Agent, or Firm*—Milton M. Field

[57] ABSTRACT

A protective pillow assembly incorporates an air-impervious transparent plastic hood. In case of fire, the hood is placed over the user's head, the assembly being so arranged that the user breathes through the pillow, or pillow batting, which acts as a smoke filter. In one embodiment, a special pillow instruction is used. An outer air-pervious sleeve cooperates with an inner sleeve, which has an air-pervious portion and an air-impervious portion, to support pillow batting. The transparent sleeve is sealed to the air-impervious portion. In a second embodiment, a conventional pillow is inserted into an air-pervious sleeve, which is connected in overlapping relationship to the transparent hood. In both embodiments, the hood is folded and stored within the assembly. The hood may be formed of a polished polypropylene film or a lamination of Mylar film and a noise-deadening film, such as polypropylene or polyvinyl chloride. A heat-reflective thin metallic coating is incorporated in the lamination. The pillow batting may be treated with a carbon monoxide neutralizing substance.

10 Claims, 7 Drawing Figures

PROTECTIVE PILLOW ASSEMBLY

BACKGROUND OF THE INVENTION

This invention relates to means for protecting a person from smoke inhalation damage during a fire and, more particularly, to means associated with a pillow for this purpose.

It has been variously estimated that from 78% to 93% of those who die in fires, whether they be in hotel towers, such as the fire in the MGM Grand Hotel, or in ordinary residences, are victims of heavy particle, or smoke, inhalation. Those caught in fire situations are often incapacitated by dense smoke. Once they are so incapacitated, they no longer are capable of making effective decisions or of taking effective action leading to rescue or escape.

It is, of course, possible to provide every hotel or house bedroom with gas masks; but this would be impractical and costly. Indeed, it is not likely that hotel managements would willingly equip rooms with gas masks, fearing that these would alarm guests unduly and be too easily stolen. Other prior art expedients, such as the transparent hood devices shown in U.S. Pat. No. 3,521,629, U.S. Pat. No. 3,762,407, and U.S. Pat. No. 4,154,235, are impractical for the same reasons.

SUMMARY OF THE INVENTION

It is therefore an object of the invention to provide improved means for protecting persons caught in fires from the incapacitating effects of smoke inhalation.

To this end, it is proposed to incorporate a transparent hood in a pillow assembly. In case of fire, the hood is placed over a person's head, the assembly being so arranged that the person breathes through the pillow, or pillow batting, which acts as a filter removing the smoke particles. In this way, the protective device is applied as an adjunct to the pillow, a common object supplied to every bedroom. As such, it is not likely to be unduly alarming to guests and is not likely to be an object attractive to thieves.

In one embodiment of the invention, a special pillow construction, adapted to the purposes of the invention, is provided. The special pillow construction comprises a first sleeve which is closed at one end and formed of an air-pervious fabric. A transparent hood, or sleeve, formed of a flexible air-impervious plastic material is connected to the other end of the first sleeve. An elastic band is provided at the free end of the transparent sleeve which is adapted to engage the head of a person caught in a fire emergency.

Means are provided for supporting pillow batting within the first sleeve in such a manner that the pillow batting serves as a smoke filter when the transparent sleeve is engaged with a person's head. This means comprises an inner sleeve having a first portion of air-pervious material connected at one end to the one end of the first sleeve and, at its other end, to a second portion of air-impervious material connected between the other end of the first portion and the other end of the first sleeve. Pillow batting, preferrably a polyester batt filling, is stuffed in the space between the inner and first sleeves. In order to provide space for additional batt filling at the one end of the first sleeve, the first portion of the inner sleeve is sewn to itself along a line a short distance from the one end of the first sleeve.

Plastic films, such as polished polypropylene and polyvinyl chloride, are relatively quiet and may be used to form the transparent sleeve, but these materials cannot withstand relatively high temperatures. Mylar, which has better resistance to relatively high temperatures, is not suitable for use in a pillow assembly, because it is too noisy. It has been found, however, that the use of a noise dampening layer such as polypropylene or polyvinyl chloride, laminated to a Mylar layer results in a structure which has better heat-resisting characteristics than polypropylene or polyvinyl chloride alone and which is not too noisy. The heat characteristics of the sleeve are further improved by adding a thin vapor deposited heat-reflective metallic coating. The transparent sleeve may be folded and stored within the inner sleeve. A zipper on the other end of the first sleeve acts as closure means to enclose the folded transparent sleeve.

The pillow batting may be treated with a carbon monoxide neutralizing substance, such as iodine penoxide or slaughter blood.

In normal use, with the transparent sleeve folded and stored within the inner sleeve, the assembly is used as a pillow in the normal manner. In a fire emergency, the zipper is opened and the transparent sleeve is extended and slipped over the head of a person caught in the fire. The elastic band provides a snug fit around the neck of the person who then breathes through the pillow batting which functions as a smoke filter.

In a second embodiment of the invention, intended for use with a conventional pillow, the first air-pervious sleeve is connected in overlapping relationship with the transparent air-impervious sleeve. A conventional pillow, stuffed with polyester batt filling, serves as the means for supporting pillow batting and is inserted through the transparent sleeve into the first sleeve which is closed at its free end. Due to the fluffiness and length of the pillow, it presses snugly against the first sleeve and, in part, the overlapping portion of the transparent sleeve. A zipper is again provided to close the open end of the first sleeve with the transparent sleeve folded and stored therewithin. In a fire emergency, the zipper is opened and the transparent sleeve is extended and placed over the head of the person caught in the fire. The person breathes through the conventional pillow which functions as a smoke filter.

These and other objects, features, and advantages of the invention will become more readily apparent upon detailed consideration of the embodiments of the invention in conjunction with the drawings.

DETAILED DESCRIPTION

Figure 1:
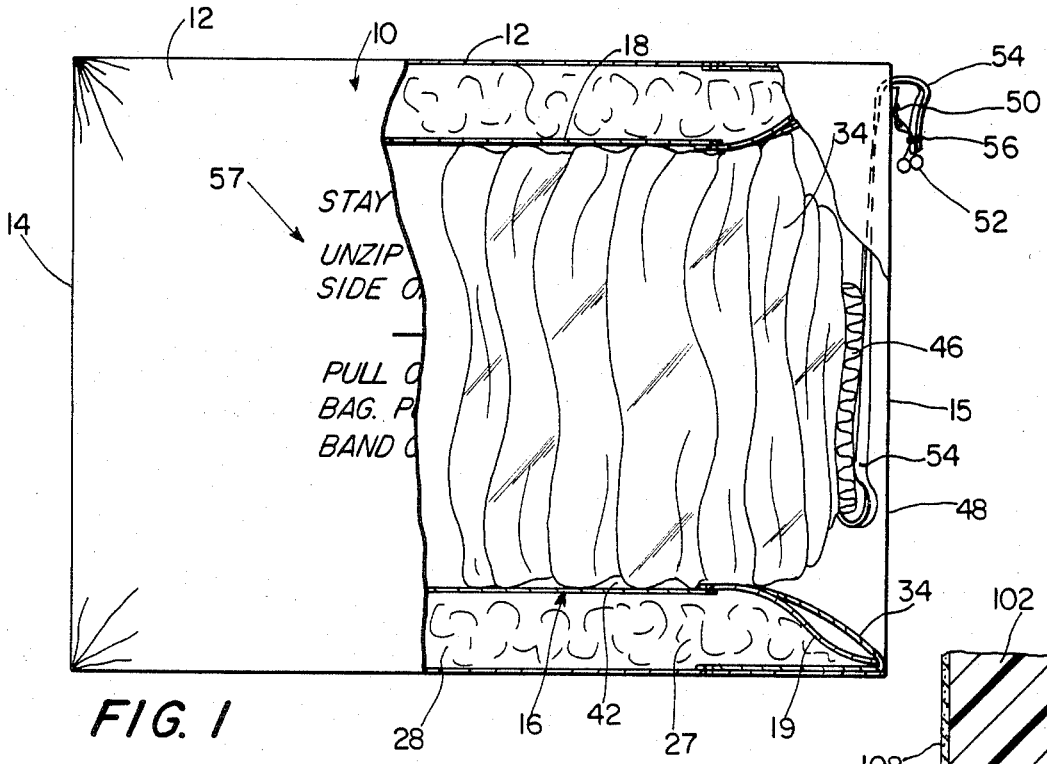
FIG. 1 is a plan view, partially broken away and partially in section, showing a first embodiment of the invention with the transparent hood folded and stored within the pillow assembly.
Figure 2:
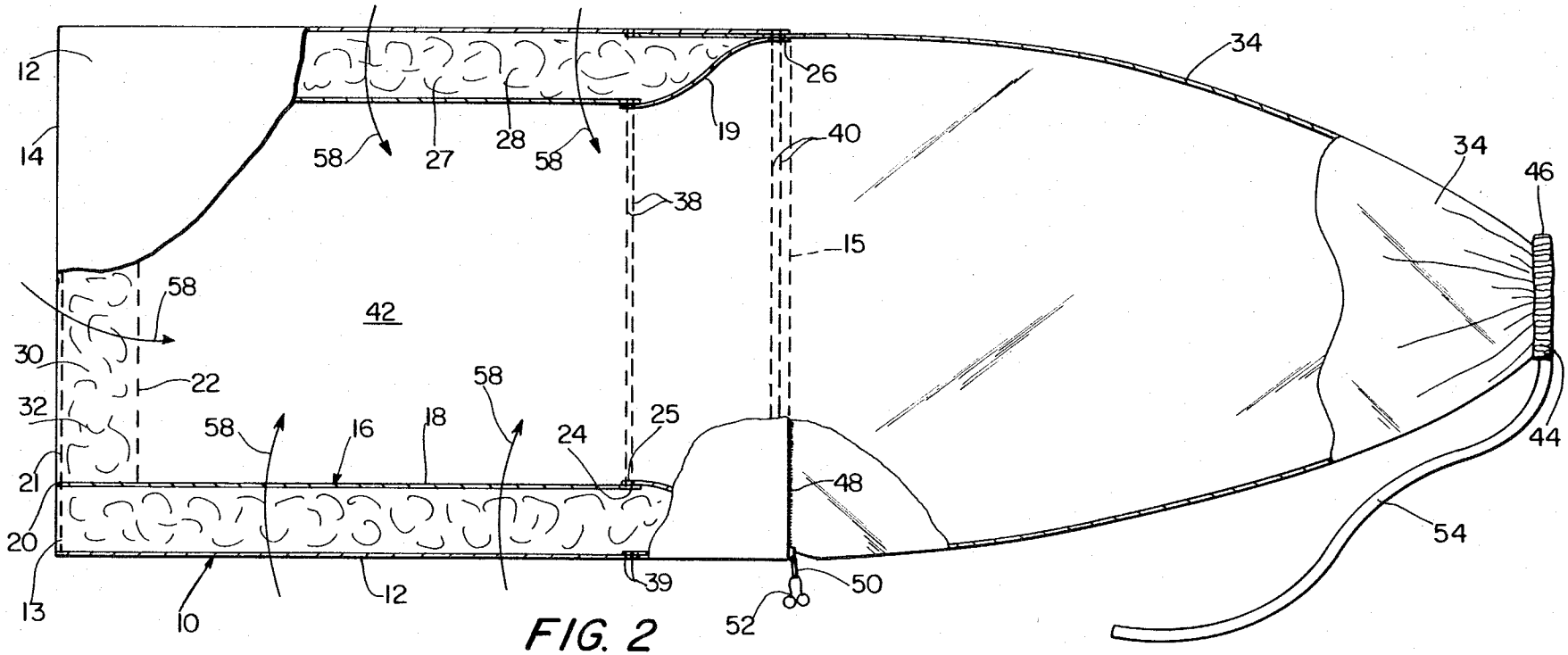
FIG. 2 is a plan view, partially broken away and partially in section, of the embodiment o FIG. 1 with the transparent hood extended.

Turning to FIGS. 1 and 2, a first, and preferred, embodiment of the invention comprises a special pillow construction 10, including a first, outer, sleeve 12 of air-pervious material, which is about the same length as a conventional pillow. It has been found that a standard 50% polyester, 50% fabric cotton pillow covering tick has the proper porosity to avoid restricting breathing. To meet all fire codes, the fabric used should conform to industry standards for flammability. One end 14 of sleeve 12 is sewn closed along sew line 13, while the other end 15 is open unless closed by closure means to be described hereinafter. An inner sleeve 16 has a first portion 18 of air-pervious material, which preferably is made of a coarsely woven fabric, such as a 100% polyester fabric of the type used in bedding. Being very porous, this fabric does not significantly impede breathing when the device is in use. A second portion 19 of inner sleeve 16 is formed of an air-impervious material, such as 2 mil polypropylene or polyvinyl chloride film, which are easily heat formed and sewn. The first inner sleeve portion 18 has a first end 20 sewn closed along sew line 21 to the closed end 14 of sleeve 12. About two inches from closed end 14, inner sleeve portion 18 is sewn closed along a sew line 22 to form a space 30 to be stuffed with pillow batting 32 as will be described below. The opposite end 24 of inner sleeve portion 18 is sewn along a pair of sew lines 38 to an end of air-impervious portion 19. Polyester thread of the type normally used for pillow stitching is preferred for these, as well as all other stitch lines, in the device.

Inner sleeve portion 18 is spaced about two inches inwardly from outer sleeve 12 to form a space 27 which is filled with pillow batting 28. Because inner sleeve portion 19 is connected at one end 25 along sew lines 38 to open end 24 of inner sleeve portion 18 and at its other end 26 along sew lines 40 to open end 15 of outer sleeve 12, it is shaped as a tapered sleeve with its large end 26 being about four inches greater in diameter than its reduced end 25 sewn at 38 to inner sleeve portion 18. Because inner sleeve portion 19 will be hidden from view by outer sleeve 12, it need not be transparent.

The batt fillings 28 and 32 are preferably Dacron polyester batt fillings, such as DuPont Dacron polyester Holofil TM-808. Other batting materials provide different effects. For example, cotton batting is more effective as a filter, but breathing becomes too difficult when it is used. The best balance of breathing ease and filtering effectiveness is obtained with the Dacron polyester batt filling. In order to prevent the batting 28 from shifting within space 27 it is attached to inner sleeve 16 along sew lines 38.

The pillow batting used at 28 and 32 may be given special chemical treatment. For example, a 10% iodine penoxide solution or slaughter blood (as a source of hemoglobin) will tend to neutralize carbon monoxide.

A clear plastic transparent hood, or sleeve, 34 is attached to the inside of sleeve 12 by means of two rows of stitching 39 about three inches from its end 15. Transparent hood 34 is also heat-sealed and sewn along lines 40 to inner sleeve portion 19 and sleeve 12 near the end 15 of sleeve 12. By virtue of this heat seal between air-impervious sleeve portion 19 and air-impervious transparent sleeve 34, an air barrier is created, beginning at the stitched lines 38, corresponding to the narrow end of inner sleeve portion 19, and extending the full length of transparent hood 34. This length is about the same as the length of sleeve 12. The open end 44 of transparent hood 34 has an elastic band 46 which will enable the hood to engage the neck of the user with a snug fit. Elastic band 46 has a minimum width of one-half inch and has an unstretched diameter of about three inches. For the purpose of slipping the hood over a user's head, the band should, under light loading, stretch to a diameter of about fourteen inches. Such a band is able to seal lightly all sizes of users' necks without impairing blood circulation.

Figure 3A:
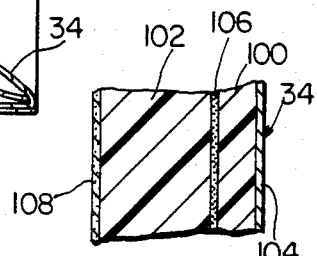
FIGS. 3A and 3B are section views showing the construction of two embodiments of trai parent hood materials.

Transparent hood 34 should be made of a clear flexible plastic material which can withstand temperatures of at least 200 degrees F. In order to increase the temperature rating of the material used, a thin, transparent metallic heat reflecting coating may be applied to the hood. A shelf life of at least five years is desirable. Since the material will be used as a part of a pillow assembly, it should not be too noisy. Polished polypropylene of two mils thickness is a suitable material. Actually, Mylar (polyethelyene terephthalate) is attractive as a material for the hood, because it has more favorable temperature characteristics (can withstand temperatures up to 400° F.); but Mylar, when used alone, is too noisy for use in a pillow. However, it has been found that a lamination of one mil Mylar with three mils polypropylene or polyvinyl chloride overcomes this problem, the polypropylene or polyvinyl chloride serving to dampen the noise generated by the Mylar. Such an embodiment of hood 34 is illustrated in FIG. 3A which shows an outer one mil Mylar (type D) film 100. A very thin vapor deposited heat reflective aluminum coating 104 (the 100 angstrom thickness of which is exaggerated in the drawing) is applied to the outside surface of Mylar film 100. This heat reflective coating should be thick enough to reflect infrared (heat) radiation but should be thin enough that it does not restrict the vision of the user unduly. It has been found that the 100 angstrom thickness used provides a satisfactory 80% reflectivity of infrared radiation and 34% of ultra violet radiation, while transmitting 60–70% of the visual light waves when located near the eye as is the case when used as a protective hood. The Mylar film 100 is laminated, by, for example, a conventional laminating adhesive 106 to a three mil film 102 of double polished polypropylene or polyvinyl chloride. Polyvinyl chloride is more pliable, less noisy and has a longer shelf life than the polypropylene. However, polyvinyl chloride has a lower temperature rating, being able to withstand temperatures up to 150°–170° F., and is known to produce toxic funes when ignited. While the polypropylene is slightly noisier, it has a higher temperature rating of 250° F. and less toxicity. A balance must be struck between these criteria in selecting which to use. In order to prevent condensation or fogging from forming on the inside surface of transparent hood 34, a standard industrial defogging agent, such as silicone oil, may be applied by spraying as coating 108 to the inside surface of film 102. This will prevent condensation from forming and impeding the vision of the user.

Figure 3B:
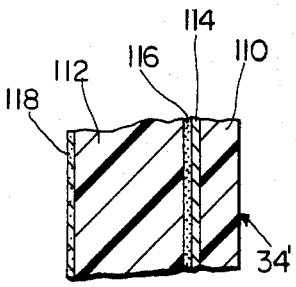

Another form of the laminated hood is shown in FIG. 3B. Here, the one mil Mylar film 110 forms the outer surface of the hood 34' with the heat reflective aluminum coating 114 applied to the inner surface of film 110. A three mil polypropylene or polyvinyl chloride film 112 is laminated to film 110 by means of laminating adhesive 116. A silicone oil defogging agent 118 is sprayed on the inside surface of hood 34'.

The open end 15 of sleeve 12 is provided with closure means in the form of a plastic zipper 48. The zipper, which may be a standard pillow tick zipper, has a pair of rows of interengagable teeth, one of which is seen in FIG. 2, sewn to respective halves of open end 15 of sleeve 12 along sew lines 40 and is provided with a zipper operator 50 to engage said rows of interengagable teeth to close the open end 15 of sleeve 12. In order to make it easy to find the zipper operator in an emergency, it is attached to a pair of red tassels 52. With the end 15 of sleeve 12 open, transparent hood 34 may be folded open end 15 and stored within a storage space 42 provided within inner sleeve 16, as is illustrated in FIG. 1. To make it easy for the user to pull transparent hood 34 from its storage space 42, a red ribbon 54 is attached to elastic band 46 at the open end 44 of hood 34. With hood 34 folded within storage space 42, as shown in FIG. 1, the end of ribbon 54 extends through a small opening left by zipper 48 and is attached by means, for example, of a rubber band 56 to one of the tassles 52 attached to zipper operator 50. Ribbon 54 is thus readily available to permit the user to pull transparent hood 34 quickly from storage space 42 in an emergency.

With transparent hood 34 folded and stored within storage space 42 as shown in FIG. 1, pillow assembly 10 has the configuration and form of a conventional pillow and may be used as a pillow. Emergency instructions 57 may be printed on the fabric of outer sleeve 12 as is shown in FIG. 1. A typical emergency message may state: "Stay calm. Unzip right side of pillow. Pull out plastic bag. Pull elastic band over head." The same instructions may be printed in several languages.

In a fire emergency, the user would grab zipper operator 50 or tassel 52 and unzip the end 15 of sleeve 12. He or she would then pull on ribbon 54 to remove transparent hood 34 from its storage space 42 within the pillow assembly. The user would then engage the end 44 of transparent hood 34 over his or her head and pull the end 44 down to his or her neck where it will snugly engage the neck to provide a light seal. As illustrated in FIG. 2, the user would then breathe through the pillow batting at 28 and 32 along air flow paths as shown by the arrows 58. The protection from smoke thus provided will often save the user's life.

Figure 5:
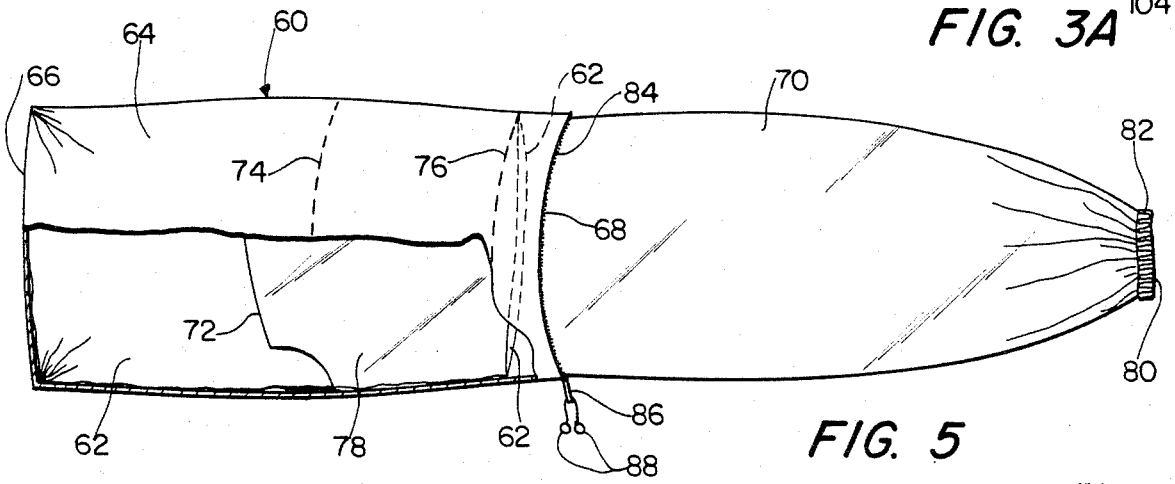
FIG. 5 is a view corresponding to the view of FIG. 4 showing the pillow inserted.
Figure 6:
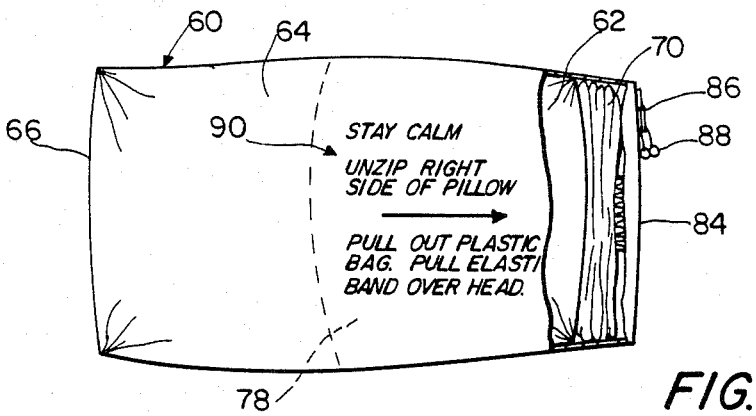
FIG. 6 is a view corresponding to the views of FIGS. 4 and 5, showing the transparent hood folded and stored within the pillow assembly.
Figure 4:
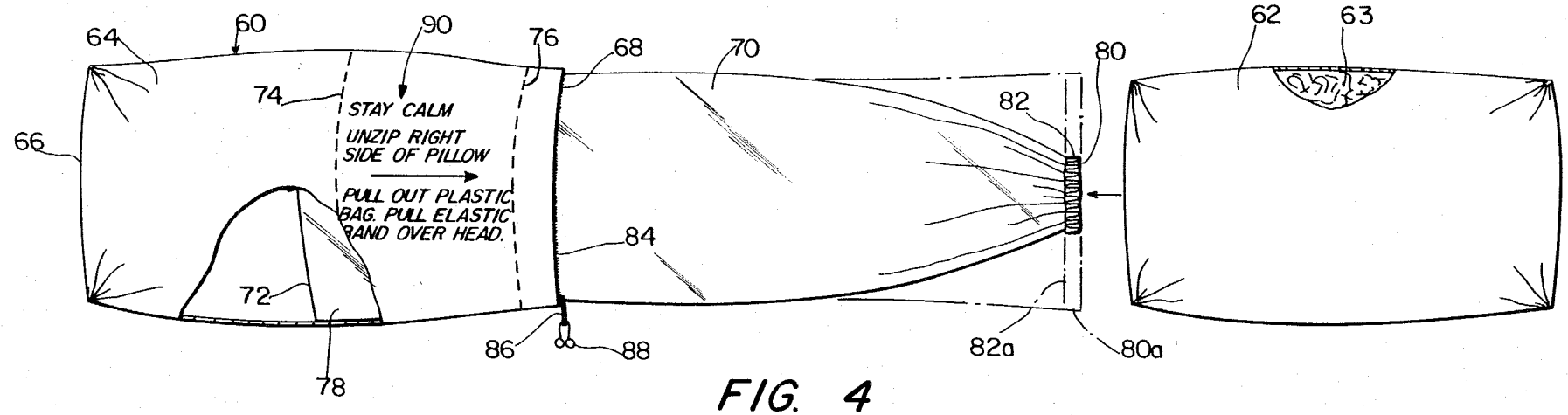
FIG. 4 is an exploded view, partially br ken away, of a second embodiment of the invention with the transparent hood extended and showing the method of inserting the pillow.

Another embodiment of the invention, which uses a conventional pillow, is illustrated in FIGS. 4, 5, and 6. A pillow assembly 60 is used with a conventional pillow 62 stuffed with Dacron polyester batt filling 63. The assembly includes an outer sleeve 64 of air-pervious material, such as the standard Dacron polyester-cotton pillow tick used with the embodiment of FIGS. 1 and 2. Sleeve 64 is closed, as by sewing at one end 66 and has an open end 68. A transparent sleeve, or hood, 70 formed as before, of a polished polypropylene film or a lamination of polypropylene or polyvinyl chloride and Mylar films, is attached, by means of a sew line 74, to the inside surface of outer sleeve 64. Transparent sleeve 70 is also sewn and heat sealed at line 76 to sleeve 64 near its open end 68. Thus, an end portion 78 of transparent air-impervious sleeve 70, several inches in length from the end 72 of sleeve 70 to the open end 68 of sleeve 64, overlaps air-pervious sleeve 64.

The opposite end 80 of transparent air-impervious sleeve, or hood, 70 includes an elastic band 82 which has a normal unextended diameter of about three inches. When expanded under a light load, band 82 should attain a diameter of approximately fourteen inches. A zipper closure 84 has a pair of rows of interengagable teeth attached to respective halves of the edge of open end 68 of sleeve 64 and may be closed by a zipper operator 86 to which colorful tassels 88 are attached.

The extended position of hood 70 is illustrated in FIG. 4 with pillow 62 removed from assembly 60. In order to insert pillow 62, elastic band 82 is expanded as shown at **82*a* to present an enlarged open end 80*a* of hood 70. The pillow 62 is then shoved through hood 70 fully into sleeve 64 as illustrated in FIG. 5. It is to be noted that pillow 62 is long enough to partially cover end portion 78 of transparent hood 70 and short enough that there will be sufficient room within sleeve 64 to store the extended portion of transparent hood 70 in folded condition. After the pillow is inserted, transparent hood 70 is folded and stored in sleeve 64 as is illustrated in FIG. 6. Zipper 84 is then closed by means of zipper operator 86. This is illustrated in FIG. 6**. The pillow assembly is now in condition for use as a pillow and is ready for use in an emergency.

It is to be observed from FIG. 4 that emergency instructions 90 are again printed on sleeve 64. When a fire emergency occurs, the user unzips zipper 84 and extends folded transparent hood 70. The free end 80 of the hood 70 is then placed over the user's head until the elastic band 84 snugly grips the user's neck. Because of the fluffiness of pillow 62, it firmly engages the inside wall of air-pervious sleeve 64 and transparent hood end portion 78 allowing no air to pass between sleeve 64 and the outer surface of pillow 62. Instead, all of the air, and smoke, is directed through pillow 62 and its pillow batting 63 which, again, acts as a smoke filter.

While preferred embodiments of the invention have been shown and described, it will be apparent to those skilled in the art that changes and modifications can be made without departing from the principles of the invention, the scope of which is defined in the appended claims.

The invention claimed is:

1. Apparatus for protecting a person caught in a fire emergency from smoke inhalation, comprising:

a. a first sleeve closed at one end and formed of air-pervious fabric;

b. a transparent sleeve formed of a flexible air-impervious material having one end connected completely about its periphery to the other end of said first sleeve, said transparent sleeve having means at the opposite end thereof adapted to engage the head and surround the breathing passages of said person when in said fire emergency;

c. pillow batting; and d. means for supporting said pillow batting within said first sleeve in such a manner that said pillow batting will serve as a smoke filter when said transparent sleeve is engaged with said head of said person in said fire emergency.

2. Apparatus as recited in claim 1, wherein said means for supporting said pillow batting comprises an inner sleeve having a first portion of air-pervious material extending from said one end spaced inwardly from said first sleeve and a second portion of air-impervious material connected between the other end of said first portion and the other end of said first sleeve, said inner sleeve and said first sleeve forming a space therebetween, said pillow batting being stuffed within said space between said first sleeve and said inner sleeve.

3. Apparatus as recited in claim 2, wherein said first portion is sewn together along a line near said one end of said first sleeve to define a further space between said line and said one end of said first sleeve, said further space being filled with some of said pillow batting.

4. Apparatus as recited in claim 1, further comprising an elastic band positioned about said opposite end of said transparent sleeve to hold said sleeve securely about the neck of said person.

5. Apparatus as recited in claim 1, further comprising closure means for closing said other end of said first sleeve, said transparent sleeve being adapted to be folded through said other end of said first sleeve to be stored within said first sleeve with said closure means closed.

6. Apparatus as recited in claim 1, wherein said pillow batting comprises a polyester batt filling.

7. Apparatus as recited in claim 1, wherein said transparent sleeve comprises polypropylene film.

8. Apparatus as recited in claim 1, wherein said means for supporting pillow batting comprises a pillow received within said first sleeve and partially overlapping said transparent sleeve, said pillow being stuffed with said pillow batting and being of sufficient fluffiness that it presses snugly against said first sleeve and said overlapped portion of said transparent sleeve.

9. Apparatus as recited in claim 8, wherein said pillow batting comprises polyester batt filling.

10. Apparatus as recited in claim 1, wherein said pillow batting is treated with a carbon monoxide neutralizing substance.

* * * * *